US006267094B1

(12) United States Patent
Kuettner et al.

(10) Patent No.: US 6,267,094 B1
(45) Date of Patent: Jul. 31, 2001

(54) OIL PUMP MODULE WITH FILTER IN PARTICULAR FOR INTERNAL COMBUSTION ENGINE LUBRICATING OIL

(75) Inventors: Peer-Oliver Kuettner, Stuttgart; Martin Weindorf, Kornwestheim, both of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/508,461

(22) PCT Filed: Sep. 7, 1998

(86) PCT No.: PCT/EP98/05654

§ 371 Date: Mar. 10, 2000

§ 102(e) Date: Mar. 10, 2000

(87) PCT Pub. No.: WO99/13203

PCT Pub. Date: Mar. 18, 1999

(30) Foreign Application Priority Data

Sep. 10, 1997 (DE) ..... 197 39 668

(51) Int. Cl.[7] ..... F01M 11/03; F01M 1/10

(52) U.S. Cl. ..... 123/196 A; 123/198 C

(58) Field of Search ..... 123/196 R, 196 A, 123/198 E, 198 C

(56) References Cited

U.S. PATENT DOCUMENTS

| | | | | |
|---|---|---|---|---|
| 4,624,227 | * | 11/1986 | Wunsche | 123/198 C |
| 4,758,130 | * | 7/1988 | Waterworth | 417/236 |
| 5,207,195 | * | 5/1993 | McClintic | 123/179.25 |
| 5,327,862 | * | 7/1994 | Bedi | 123/196 R |
| 5,558,058 | * | 9/1996 | Ming et al. | 123/196 A |
| 5,771,854 | * | 6/1998 | Barton | 123/196 R |

* cited by examiner

*Primary Examiner*—Noah P. Kamen
*Assistant Examiner*—Hai Huynh
(74) *Attorney, Agent, or Firm*—Crowell & Moring, L.L.P.

(57) ABSTRACT

The invention concerns an oil pump module (11) for assembling in one structural unit, an oil pump (18), an oil cooler (37) and an oil filter (43). Said module has a base element (12) capable of being produced in the form of a plastic housing. An oil pump (18) is inserted from one side and, from the other side, an oil cooler (37) and an oil filter (43). Moreover, the oil pump (18) is sealingly pressed, by the base element (12), against an internal combustion engine frame, so as to be driven by said engine. The invention enables to obtain not only a particularly compact and light oil pump module (11), but also an entire pre-assembled unit, with complete module control at the supplier's.

15 Claims, 1 Drawing Sheet

OIL PUMP MODULE WITH FILTER IN PARTICULAR FOR INTERNAL COMBUSTION ENGINE LUBRICATING OIL

FIELD OF APPLICATION AND STATE OF THE ART

The invention relates to an oil pump module for an internal combustion engine, especially of a motor vehicle, containing at least one oil pump and oil cleaning means.

At present it is common, especially in automotive manufacture, to provide and install separately the oil pump and corresponding oil cleaner for the internal combustion engine.

This requires considerable expense and effort since at least two installation steps are necessary for assembly.

For this reason so-called oil pump modules have been developed which are intended to provide for greater integration of the components. A number of solutions have been proposed, but they achieve the desired purpose partially or not at all.

OBJECT AND SOLUTION

The object of the invention is to provide an oil pump module for an internal combustion engine, especially a motor vehicle, which provides sufficient integration of the components, simplification of installation, and a practical arrangement of the individual parts.

This object is achieved in that the oil pump and the oil cleaner are arranged at least partially in or on a common base element. In this manner a unit is formed which as an assembly requires but a single installation step. The base element joining together the oil pump and the oil cleaner can serve for the oil-carrying connection together of the two parts and contribute to stability. The base element can function either as a kind of support plate, or else it can preferably at least partially comprise or enclose the oil pump and/or the oil cleaner.

In order to achieve a weight reduction, which is desirable especially in automobile design, the base element can be made largely of plastic. In this manner the production of the base element becomes easier and cheaper. Many plastics can be used which can withstand the stresses involved in installing it on or near the internal combustion engine. Plastics with glass or carbon fiber inclusions can be used with preference, and the base element can be made preferably by injection molding.

In order to affix the oil pump module, in one embodiment the base element can be joined to the body of the internal combustion engine, especially by a releasable fastening, such as bolting. Thus the oil pump module can be mounted and removed easily in order to perform any necessary maintenance and repair work.

Preferably the oil pump is driven by the internal combustion engine, especially through a drive shaft reaching into the body of the internal combustion engine, while coupling can be achieved through an angle drive on the drive shaft. A separate drive for the oil pump can thus be dispensed with.

Advantageously, the base element can be placed against the internal combustion engine or its body, and especially pressed against it with sealing. Separate fastening of the oil pump to the internal combustion engine is thereby eliminated. Furthermore, since the oil pump is connected directly to the internal combustion engine the above-described driving connection as well as an oil carrying connection can be carried out especially conveniently. This can reduce the entire size of the internal combustion engine with its oil pump module.

Advantageously the oil is pumped out of the internal combustion engine into the oil pump through corresponding openings in an oil pump case which match openings in the body of the internal combustion engine to which they are applied. Thus conduits otherwise commonly used, such as pipes or hoses, can be dispensed with.

In a preferred embodiment, the oil pump centers itself, and the oil pump module, when fastened to the body of the internal combustion engine itself, enters by means of a projection on the oil pump case which engages an opening corresponding thereto into the body of the internal combustion engine. Not only can a definite position of the oil pump with respect to the internal combustion engine be assured, but in addition an exact adjustment of the oil carrying openings to the oil pump. The oil pump can be secured against axial rotation of the oil pump since the entire oil pump module is held by the base element.

Advantageously, the oil pump's drive shaft runs through the % projection, and it can especially be journaled in a bearing, for example a slide bearing directly in the oil pump case. Preferably the oil pump is covered toward the base element by an oil pump cover which is preferably shaped to match the form of the pump rotors. For that purpose it can be plate-like and seal off the oil pump at least partially on the outside. The oil pump cover does not necessarily have to be fastened directly to the oil pump or to its casing, but can be pressed by the base element against the oil pump and secured against rotation.

In one embodiment of the invention the base element can at least partially surround and/or seal off the oil pump. This makes it possible to insert the parts of the oil pump loosely into the base element, thereby holding the parts together.

For high integration and improved operation it is advantageous that oil flows at least through a portion of the base element. This increases the number of design possibilities, since the oil pump does not necessarily have to be joined directly to the oil cleaning means. Preferably the base element can have guiding means, especially guiding passages, for an oil flow, which can be connected directly to the oil pump. Especially the base element can be a direct oil carrying means. In this manner separately attached parts such as tubes or pipes can be dispensed with.

In one preferred embodiment of the invention, at least one oil cooler, especially an oil cooler with water flowing through it, can be present, which is connected sealingly to the base element or is surrounded by it. Channels in the base element to carry the oil can be connected sealingly and directly to corresponding openings of the at least one oil cooler. In this manner the base element can additionally assume the function of the at least partial carrying of the oil stream.

Preferably at least one oil cooler can be connected to the oil cleaning means, especially by sealed contact pressure. Thus an oil flow can be achieved without other auxiliary means. Advantageously, the oil flow which is carried at least once, preferably twice, through the at least one oil cooler, can be carried between at least two currents through the oil cleaning means. In this manner the cooling effect can be intensified and the oil circulation can also be simplified.

In a preferred embodiment of the invention the oil pump (in the direction of the flow of the oil) is arranged especially as the first component after the oil exits from the internal combustion engine, before entering into the at least one oil cooler. This oil cooler can preferably be arranged ahead (in the direction of oil flow) of the entrance into the oil cleaning means. The oil pump can thus force the oil through the components that follow. The oil cleaning means can preferably include at least one oil filter. In the latter any dirt particles or the like carried by the oil can precipitate or be separated from the oil.

Advantageously, the oil pump can be an internal gear pump, especially a trochoidal pump, the rotors of which rotate in a rotor housing which preferably consists of metal. In further embodiment the rotor housing can serve simultaneously as an oil pump casing. Such an internal gear pump is reliable and requires little space. By making the rotor housing of metal greater accuracy of manufacture can be obtained and a reduction of wear. Also the rotors of the oil pump consist preferably of metal, and sintered steel rotors are mainly desirable.

In further embodiment of the invention at least one gear, preferably the internal rotor with trochoidal teeth, can be joined directly to a drive shaft, preferably releasably joined. In that case it can be superimposed with a form-locking connection. The possibility of easy separation between the drive shaft and the internal rotor facilitates repairs and maintenance work.

Advantageously, the base element completely envelops the at least one oil cooler and the oil cleaning means and seals them against one another, preferably by axial compression. These parts can be inserted into the base element through an opening, especially an opening which can be closed with a fastenable cap. After the cap has been replaced they are thus completely enveloped and sealed from the exterior.

In one embodiment of the invention, after the base element is opened, preferably by removing a screw cap, the oil cleaning means is removable at one end separately from the other components of the oil pump module, to facilitate changing the oil filter.

In a preferred embodiment of the invention the oil pump can be joined to the base element on a different side, preferably inserted therein, than the oil cleaning means and/or the at least one oil cooler. An approximately right-angle arrangement of the components is advantageous, in regard to both compactness and functionality.

According to a preferred embodiment of the invention, a base element made in the form of a plastic housing is created, and an oil cooler and an oil filter are inserted into an opening provided at one end and closed with a screw cap; the housing largely envelops the oil pump casing on another side, ends flush with the latter, and with this flush surface and a gasket it is pressed against the body of the internal combustion engine by bolting the base element to it. In that case, in the area of the oil cooler, two connections for coolant for the latter can project from the base element, and the drive shaft of the oil pump can reach into the body of the internal combustion engine.

Preferably the components of the oil pump module are sealed against one another as well as from the exterior by appropriate sealing means, particularly molded axial gaskets. Due to the substantial envelopment of the oil pump, oil cooler and oil filter by the housing of the base element a unit that is easy to seal can preferentially be made.

These and additional features of preferred embodiments of the invention will be found not only in the claims but also in the description and the drawings, the individual features being patentable embodiments, for which protection is hereby claimed. The subdivision of the application into individual sections as well as 5 inserted titles do not limit the general applicability of the statements given under them.

BRIEF DESCRIPTION OF THE DRAWING

An embodiment of the invention is represented in the sole drawing and is further explained below. The drawing shows an oil pump module according to the invention in an exploded view.

DESCRIPTION OF A PREFERRED EMBODIMENT

Figure 1:
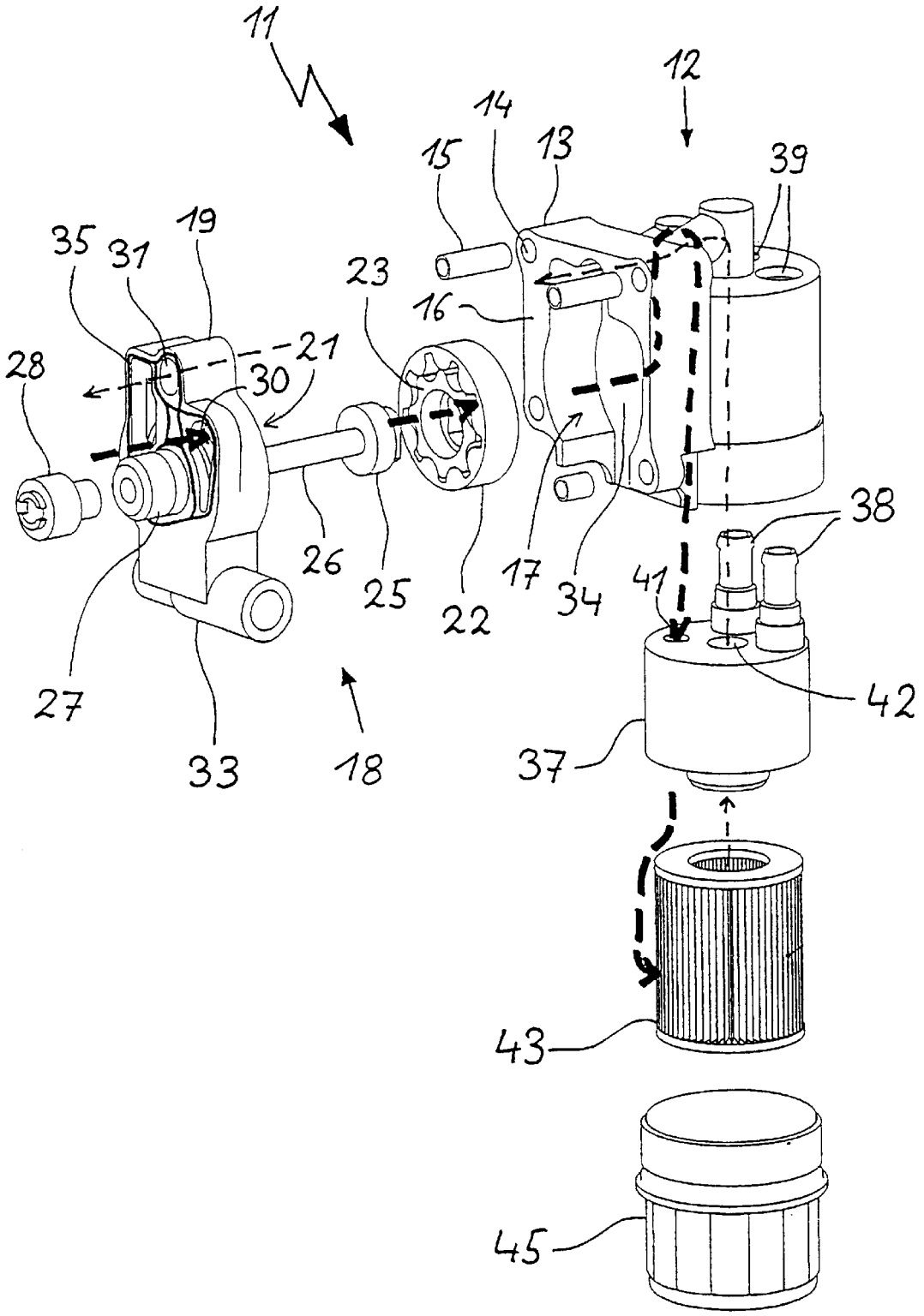

The drawing shows an oil pump module 11 according to the invention, which is represented exploded into its essential parts for better comprehension. It can also be seen from the drawing how the oil pump module 11 is to be assembled.

A base element 12 made in the form of a synthetic resin housing is comprised of an approximately cylindrical part which merges, approximately at right angles to the cylinder axis, with a flange-like housing section 13. This housing section has an approximately quadrangular, especially approximately square cross section. At its four comers bores 14 are provided into which metal sleeves 15 can be inserted. The diameter of the bores 14 and of the metal sleeves 15 is selected such that the metal sleeves 15 are forced into the bores and thereby secured. By means of threading possibilities or the like, not represented, which are brought through the metal sleeves 15, the base element 12 is pressed with a face 16 of the housing section 13 against a body, not shown, of an internal combustion engine, and affixed to it.

The housing section 13 of the base element 12 has a recess 17 of such shape that an oil pump housing 19 of an oil pump 18 can be precisely fitted into it. At the same time the housing section 13 is open at the bottom in the drawing, since in this area the dimensions of the oil pump case 19 exceed those of the housing section 13.

The oil pump housing 19, which can be made preferably of metal, especially aluminum, by the injection molding process, is preferably made in one piece. On its side not visible in the drawing it has a circular opening or pump support 21 for an outer rotor (internal gear) 22, the diameters of the two providing a reliable mounting of the outer rotor for rotation. In the outer rotor 22 there is an inner rotor (external gear) 23 which is mounted off-center from the outer rotor 22. At the lower area the troichoidal teeth of the external gear 23 in FIG. 1 engage with teeth of matching shape on the inside of the outer rotor 22. The inner rotor (external gear) 23 has one tooth less than the outer rotor 22 has projections.

The inner rotor 23 is driven by a coupling 25 which is held on a drive shaft 26. This drive shaft 26 is slidingly mounted in a cylindrical projection 27 which is located on the side of the oil pump case 19 remote from the base element 12 and extends away from it. The projection 27 and thus the drive shaft 26 of the inner rotor 23 are arranged off-center from the pump support 21 and the outer rotor 22, slightly lower in the drawing. In this way the pumping operation characterizing the troichoidal pump thus configured is achieved, which requires no further discussion here. At the other end, the drive shaft 26 has an angle drive 28 which is connected with a corresponding connection in the body of the internal combustion engine.

The oil pump housing 19 is inserted into the recess 17 of housing section 13 of the base element 12 and is forced by the latter with its front face seen in the drawing against the body of the internal combustion engine. The cylindrical projection 27 with drive shaft 26 and angle drive 28 thus extends into the housing. To introduce oil into the oil pump 18 the oil pump case 19 has an inlet opening 30 and an outlet opening 31 through which the oil enters and leaves, respectively. The broken arrows indicate the direction of flow of the stream of oil.

A balancing valve 33 is provided on the lower end of the oil pump housing 19, and returns pumped oil from the discharge to the suction side if a pressure limit is exceeded. In this manner the balancing valve 33, made in the form of a sliding piston pressure control valve, for example, limits the system pressure to an anticipated maximum throughout the speed range.

The covering of the oil pump 18 at the housing section 13 is provided by a pump cover 34 which is made in the form of a sheet metal plate. The sealing of the oil pump case 19 to the body of the internal combustion engine is performed by an all-around gasket 35 inserted into the connection face of the oil pump case 19 and repeatedly divided, which individually surrounds both the cylindrical projection 27 and the inlet and outlet openings 30 and 31 of the oil pump and thus prevents the escape of oil.

A cylindrical oil cooler 37 is inserted from the bottom into the cylindrical section of base element 12. It is in the form of a round oil cooler and is supplied with water as coolant. The cooling water supply is provided through two connection nipples 38 which extend through two corresponding openings 39 in the synthetic resin housing of the base element 12. By means of cap nuts screwed onto threads on the base of the connection nipples 38 after the oil cooler 37 has been inserted into the base element 12, the oil cooler 37 is fastened to the base element and sealed in by an axial molded gasket. Cooling water hoses or the like can be connected to the nipples 38.

The oil cooler 37 has an oil inlet 41 through which oil is introduced into the oil cooler for cooling. Since the manner of operation of the disk oil cooler is known, it is not further discussed herein. A round oil filter 42 is pressed against the free end of the oil cooler 37 by means of a cap 45 placed over it, which is threaded onto the bottom end of the cylindrical section of the base element 12 and closes the housing of the base element. The inside diameter of the cap 45 is slightly larger than the outside diameter of the oil filter, so that an oil flow issuing from the bottom of the oil cooler 37 can distribute itself sufficiently around the entire oil filter 43. It passes through the oil filter 43, exits from its center through an oil passage 42 passing centrally through the oil cooler 37, out of the oil pump module 11 at the discharge opening 46, and into the internal combustion engine 30.

The connections of the parts of the oil pump module 11, especially those joining the base element with the oil pump case 19 and of the oil cooler 37 to the oil filter 43 and the connection of the base element to the cap 45, are preferably sealed by gaskets. For example, rubber or silicone gaskets and seals are suitable for the purpose. It is a property of the oil module of the invention that by including the components, oil pump 18, oil cooler 37 and oil filter 43 in the housing of the base element 12 it is easily possible to fasten them together and seal them in. Furthermore, the base element 12 not only forms the means of fastening the oil pump 18 to the body of the internal combustion engine but also attaches the latter to the pump cover 34.

OPERATION

To assemble the oil pump 18, the drive shaft 26 is passed through the cylindrical projection 27, the inner rotor 23 is placed on the coupling 25, and pushed together with the outer rotor 22 into the pump support 21. Then the angle drive 28 is placed on the drive shaft 26 and the balancing valve 33 is inserted into the oil pump housing 19. Then the preassembled oil pump 18 is guided into the recess 17 provided for it, with a gasket if desired, the pump cover 34 being already placed into the base element 12. Finally the gasket 35 is inserted into a recess provided for it on the front face of the oil pump 18. Then a stamped sheet metal plate serving as the oil pump cover 34 is placed in the oil pump housing 19.

To assemble the oil pump module 11 according to the invention, first the oil cooler 37 together with gaskets is introduced into the cylindrical section of the base element 12, and by means of cap nuts placed on the connection nipples it is bolted and affixed thereto and sealed. The oil filter 43 is placed on the bottom end of the oil cooler 37, preferably by means of a round projection of the oil cooler 37 reaching into the opening of the oil filter 43, and seals radially with this projection. The cap 45 is placed over the oil filter 43 and with a thread, preferably an internal thread, is screwed onto a corresponding thread on the cylindrical section of the base element 12. A gasket is also provided here between the base element 12 and cap 45.

Thus preassembled, the oil pump module 11 according to the invention can be made by a supplier, for example, and delivered to the automobile manufacturer. If the entire oil pump module is assembled by the supplier it can be examined and tested by the supplier. For final installation, screws or the like, which are passed through the metal sleeves 15 of the housing section 3 of the base element 12 and engage the body of the internal combustion engine, the oil pump module can be fastened to the latter. Thus its easy and quick installation is made possible near to the final assembly. To replace an oil filter, it is necessary only to unscrew the cap 45, replace the oil filter element, and screw the cap back on again.

Oil, especially dirty oil, issues from an opening, not shown, of the internal combustion engine, through the inlet opening 30 into the oil pump 18. By the pumping action of the oil pump 18 configured as a trochoidal pump, the oil is introduced as indicated by the broken arrow through the pump gears 22 and 23 into passages in the base element 12. It passes through the left prominence on the cylindrical section of the base element 12 into the oil entry 41 of the oil cooler 37. In the latter the oil heated by the processes in the internal combustion engine is cooled. The oil cooler 37 configured as a round disk oil cooler has in its structure a plurality of round disks placed one on the other and closed on the outside, thus forming adjacent disk-shaped chambers. Cooling water passes through one chamber and oil through another, alternately. At the bottom end the cooled oil issues from the oil cooler 37 and is distributed through the circumferential surface of the oil filter 43.

In the space formed between the outer wall of the oil filter 43 and the cap 45 over it, the oil flow can distribute itself uniformly around the oil filter 43. The pump pressure forces the oil through the oil filter and the oil is cleaned of impurities and foreign particles.

The cleaned oil passes centrally out of the oil filter 43 through the oil passage 42 into a passage in the cylindrical section of the base element 12. This is the right-hand prominence on the cylindrical section in the drawing. This passage leads into the outlet opening 46 in the pump case 19 and through the latter the cooled and filtered oil passes into the body of the internal combustion engine at another point.

What is claimed is:

1. An oil pump module for an internal combustion engine, comprising at least one oil pump and oil cleaning means, wherein said oil pump and said oil cleaning means are arranged at least partially in or on a common base element, said common base element being formed of synthetic resin material and being attachable to an internal combustion engine body, said base element comprising a housing section having a recess configured to receive a precisely fitting oil pump housing of an oil pump, and said base element housing section being broken through at a location in order to receive in said location the oil pump housing which projects outwardly beyond said base element housing section.

2. An oil pump module according to claim 1, wherein said base element is bolted to the internal combustion engine body.

3. An oil pump module according to claim 1, wherein said oil pump housing is mounted in tight contact against the body of the internal combustion engine, and oil is supplied from the internal combustion engine to the oil pump through an opening in the oil pump housing which registers with a corresponding opening in the body of the internal combustion engine in the area of contact between the oil pump housing and the body of the internal combustion engine.

4. An oil pump module according claim 1, wherein the oil pump housing has a projection which mates with a corresponding recess on the body of the internal combustion engine when the oil pump module and oil pump are mounted on the engine, whereby the oil pump module and oil pump are self-centering, and wherein an oil pump drive shaft is provided which extends through said projection and which is slidingly mounted.

5. An oil pump module according to claim 1, further comprising at least one oil cooler sealingly connected to said base element with oil carrying openings of said at least one oil cooler being sealingly connected directly to corresponding oil-carrying channels in said base element.

6. An oil pump module according to claim 5, wherein said oil cooler is a water-cooled heat exchanger.

7. An oil pump module according to claim 5, wherein said oil cooler is enclosed within said base element.

8. An oil pump module according to claim 1, wherein said oil pump is an internal gear pump having rotors which run in a rotor housing formed by the oil pump housing.

9. An oil pump module according to claim 8, wherein said oil pump is a trochoidal pump.

10. An oil pump module according to claim 8, wherein said rotor housing is a metal housing.

11. An oil pump module according to claim 1, further comprising an oil cooler and wherein said oil cooler and said oil cleaning means are enclosed within said base element in sealed communication with one another, and said base element having an opening therein through which said oil cooler and said oil cleaning means can be inserted therein, and a fastenable cover for closing said opening after insertion of said oil cooler and said oil cleaning means into said base element.

12. An oil pump module according to claim 11, wherein said oil cooler and said oil cleaning means are sealed relative to each other by being pressed tightly together against each other.

13. An oil pump module according to claim 11, wherein said oil cleaning means is separately removable from said base element after unscrewing and removing said cover.

14. An oil pump module according to claim 1, wherein said oil cleaning means comprises an oil filter.

15. An oil pump module according to claim 1, wherein said base element is a synthetic resin housing having an opening at a first end through which an oil cooler and an oil filter can be inserted into said base element, and a threaded cover for closing said opening, and said synthetic resin housing at a second end substantially surrounding the oil pump housing such that a face of the synthetic resin housing is flush with a face of the oil pump housing so that the flush faces of said synthetic resin housing and said oil pump housing can be pressed through an interposed gasket against the body of the internal combustion engine by bolting said the base element to the internal combustion engine, and wherein two coolant connections for the oil cooler extend out of the base element, and an oil pump drive shaft extends out of said oil pump housing into the body of the internal combustion engine.

* * * * *